US009243862B1

(12) United States Patent
Webb et al.

(10) Patent No.: US 9,243,862 B1
(45) Date of Patent: Jan. 26, 2016

(54) ARROW REST ASSEMBLY WITH TANGENTIAL SUPPORTS

(71) Applicant: TruGlo, Inc., Richardson, TX (US)

(72) Inventors: Greg Webb, Garland, TX (US); John Estridge, Plano, TX (US); Paul LoRocco, Dallas, TX (US)

(73) Assignee: TruGlo, Inc., Richardson, TX (US)

( * ) Notice: Subject to any disclaimer, the term of this patent is extended or adjusted under 35 U.S.C. 154(b) by 0 days.

(21) Appl. No.: 14/224,597

(22) Filed: Mar. 25, 2014

(51) Int. Cl.
*F41B 5/22* (2006.01)
*F41B 5/14* (2006.01)

(52) U.S. Cl.
CPC ..... *F41B 5/143* (2013.01)

(58) Field of Classification Search
CPC ..... F41B 5/143
See application file for complete search history.

(56) References Cited

U.S. PATENT DOCUMENTS

| | | | | |
|---|---|---|---|---|
| 4,282,850 | A | 8/1981 | Warnicke | |
| 4,299,195 | A | 11/1981 | Norris | |
| 4,372,282 | A | 2/1983 | Sanders | |
| 4,492,214 | A | 1/1985 | Kielhoffer | |
| 4,858,589 | A | 8/1989 | Chang | |
| 4,917,072 | A | 4/1990 | Chang | |
| 5,042,450 | A | 8/1991 | Jacobson | |
| 5,386,814 | A | 2/1995 | Denton | |
| 5,592,930 | A | 1/1997 | Roberts et al. | |
| RE38,096 | E | 4/2003 | Branthwaite et al. | |
| 6,557,541 | B2 * | 5/2003 | Pinto, Jr. | 124/44.5 |
| 6,742,510 | B2 | 6/2004 | Troncoso, Jr. | |
| 6,772,747 | B1 | 8/2004 | Vastag | |
| 6,978,775 | B2 | 12/2005 | Graf | |
| 6,994,080 | B1 | 2/2006 | Yoder | |
| 7,827,979 | B2 | 11/2010 | Rager | |
| 7,913,678 | B2 | 3/2011 | Hudkins | |
| 8,875,687 | B1 * | 11/2014 | Huang et al. | 124/44.5 |
| 2014/0083403 | A1 * | 3/2014 | Khoshnood | 124/44.5 |

* cited by examiner

*Primary Examiner* — John Ricci
(74) *Attorney, Agent, or Firm* — Alvin R. Wirthlin

(57) ABSTRACT

An arrow rest for supporting the shaft of an arrow includes a first support frame and a plurality of support members connected to the support frame for defining at least a portion of an opening with a central axis for receiving the shaft of an arrow. Each support member has a base portion connected to the first support frame that extends towards the shaft of an arrow, and a support portion that extends from the base portion for tangentially engaging the shaft of an arrow in a direction at least generally parallel to the central axis.

20 Claims, 10 Drawing Sheets

ARROW REST ASSEMBLY WITH TANGENTIAL SUPPORTS

BACKGROUND OF THE INVENTION

This invention relates generally to accessories for archery bows, and more particularly to an arrow rest connectable to the riser of an archery bow.

In hunting, 3D archery, and field archery, accuracy is of paramount importance. The presence of the arrow rest plays a very significant role in achieving accuracy in shooting. There are at least four factors in the operation of a compound bow which may be affected by the presence of the arrow rest. First, the trajectory of the arrow can be altered when the fletching of the arrow contacts the rest, especially if the cock feather is oriented incorrectly with respect to the arrow rest. Second, because all arrows are sized to bend slightly under the instantaneous load applied to the shaft upon release, the trajectory of the arrow can be altered by its deflection against the rest, especially if the rest is rigid. Third, during release of the arrow, the archer may subject the bow to some inadvertent horizontal, vertical and/or torsional movement that may be transferred to the rest and thence to the arrow, thereby causing the trajectory of the arrow to be altered. Fourth, noise generated as the arrow shaft slides across the arrow rest can be sufficient to create undesirable friction and frighten game during hunting.

It would therefore be desirous to provide an arrow rest that overcomes one or more of the above-mentioned factors.

BRIEF SUMMARY OF THE INVENTION

According to one aspect of the invention, an arrow rest for supporting the shaft of an arrow includes a first support frame and a plurality of support members connected to the support frame for defining at least a portion of an opening with a central axis for receiving the shaft of an arrow. Each support member has a base portion connected to the first support frame and a support portion that extends from the base portion. The support portion forms a tangential point of the opening for tangentially engaging the shaft of an arrow.

BRIEF DESCRIPTION OF THE DRAWINGS

The foregoing summary as well as the following detailed description of the preferred embodiments of the present invention will be best understood when considered in conjunction with the accompanying drawings, wherein like designations denote like elements throughout the drawings, and wherein.

It is noted that the drawings are intended to depict only exemplary embodiments of the invention and therefore should not be considered as limiting the scope thereof. It is further noted that the drawings are not necessarily to scale. The invention will now be described in greater detail with reference to the accompanying drawings.

DETAILED DESCRIPTION OF THE INVENTION

Figure 1:
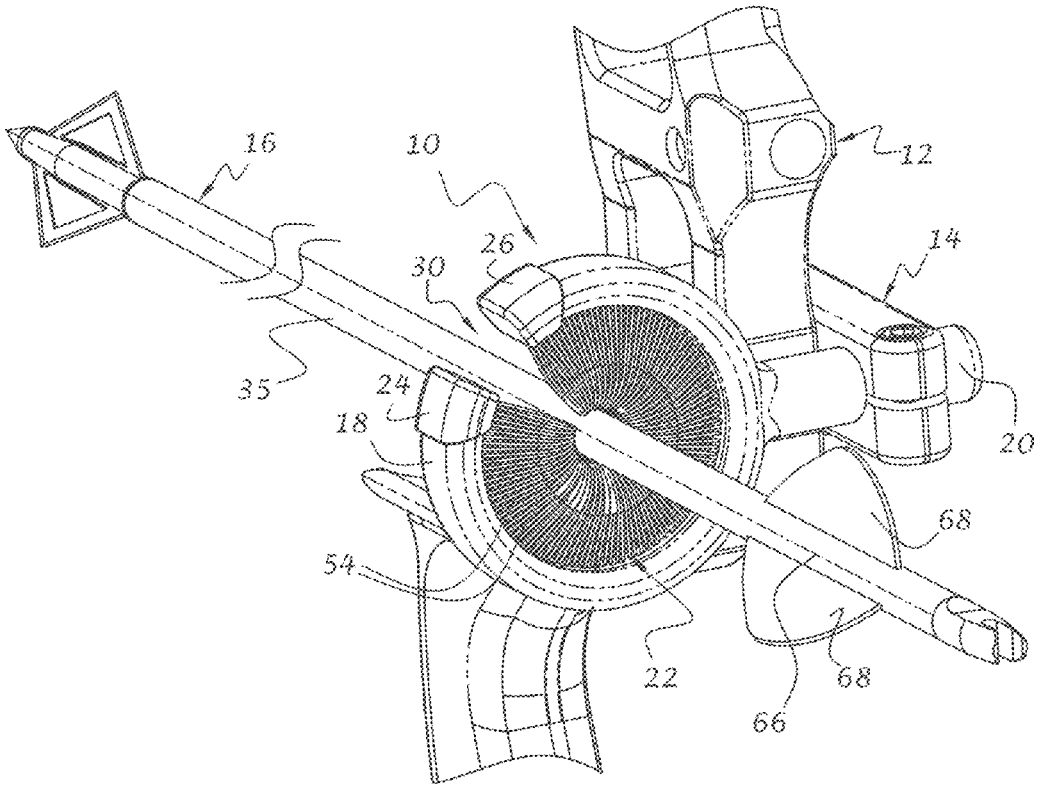
FIG. 1 is a rear isometric view of an arrow rest assembly in accordance with the present invention connected to the riser of an archery bow with an arrow extending through the rest for demonstrating how the rest captures and holds the arrow shaft.
Figure 2:
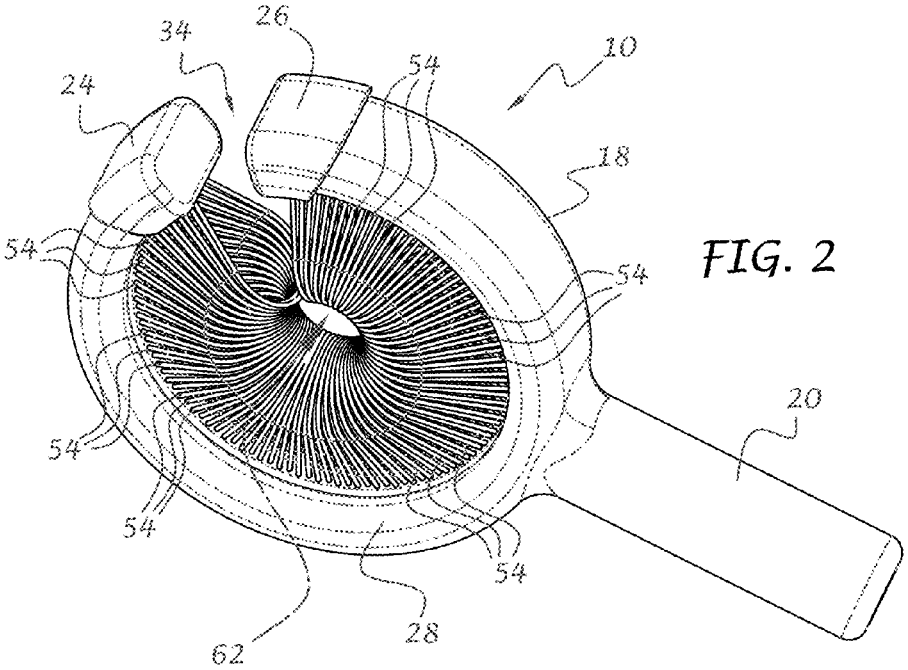
FIG. 2 is a rear isometric view of the arrow rest assembly shown from a different viewing angle to illustrate the arrow support features.

Referring now to FIG. 1 of the drawings, an arrow rest assembly 10 in accordance with an exemplary embodiment of the present invention is shown. The assembly 10 is connected to the riser 12 of a compound archery bow via a mounting bracket 14 for capturing and supporting an arrow 16 during drawback and firing of the archery bow. The riser 12, mounting bracket 14, and arrow 16 are for contextual purposes only as the arrow rest assembly 10 of the present invention can be adapted for use with any type of arrow, mounting bracket, and/or bow including, but not limited to, crossbows, recurve bows, reflex bows, longbows, and so on.

With additional reference to FIGS. 2-6, the arrow rest assembly 10 preferably includes an outer support frame 18 with an attached windage adjustment rod 20 that extends laterally therefrom and is received within the mounting bracket 14, and an inner core 22 connected to the frame 18 for supporting the arrow 16. End caps 24, 26 are connected to opposing terminal ends 30, 32 of the frame for retaining the core portion 22 in the frame 18. It will be understood that the windage rod 20 can be integrally formed with the support frame 18 or formed separately and connected thereto through well-known fastening means, as is known in the art.

Figure 3:
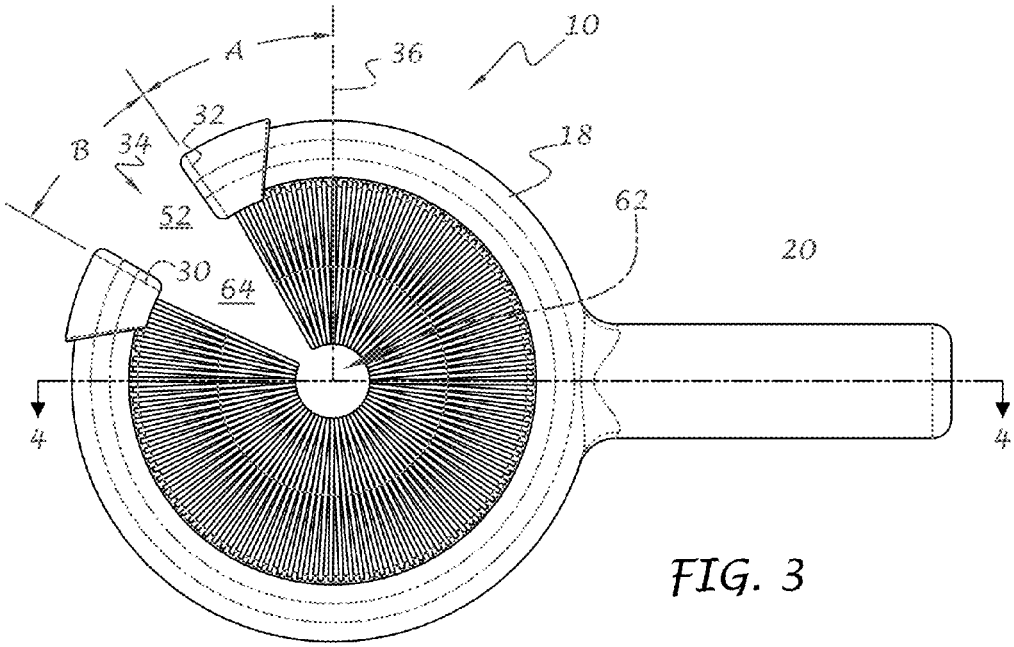
FIG. 3 is a rear elevational view thereof.
Figure 4:
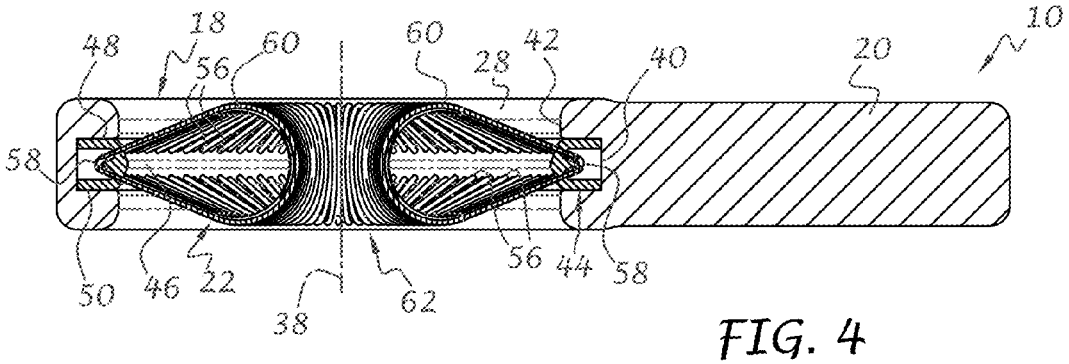
FIG. 4 is a longitudinal sectional view of the arrow rest assembly taken along line 4-4 of FIG. 3.

The outer support frame 18 preferably comprises a generally annular-shaped body 28 with the first terminal end 30 circumferentially spaced from the second terminal end 32 to define a space or gap 34 therebetween. As best shown in FIG. 3, the gap 34 is offset from a vertical line 36 extending perpendicular to a central axis 38 (FIG. 5) of the frame 18 by an angle "A". The size and shape of the gap 34 is defined by an angle "B" between the first terminal end 30 and second terminal end 32 of the body 28 such that the gap 34 is generally wedge-shaped. The angle "B" is preferably large enough to accept an arrow shaft 35 (FIG. 1) of the largest available diameter such that the arrow shaft can easily slip through the gap 34 and be supported on and/or captured by the core portion 22. Although the gap 34 is shown at a particular angle with respect to the vertical line 36, it will be understood that the gap 34 can be centered on the vertical line or at any other location without departing from the spirit and scope of the invention. It will be further understood that the gap 34 can be removed such that the frame 18 forms a fully enclosed aperture. With this arrangement, the arrow 16 can be inserted axially through the central axis 38 of the frame. Moreover, it will be understood that the present invention is not limited to an annular frame but may be of any shape and/or configuration for supporting and retaining the core portion 22. It is also anticipated that the frame may be eliminated and that the core portion 22 be directly connected to the windage rod 20 or other structure for mounting the core portion 22 to the riser 12 of a bow.

An inner annular channel 40 (FIGS. 4 and 5) is formed in the inner surface 42 of the annular-shaped body 28 for receiving the core portion 22. In accordance with one preferred embodiment of the invention, the frame 18 is formed of a material that is sufficiently resilient to expand over the core portion 22 and snap back to its original position when the core portion 22 is received within the inner raceway 40 during assembly of the arrow rest assembly 10. In accordance with another preferred embodiment of the invention, the core portion 22 is constructed of one or more materials that are sufficiently resilient such that the core portion is annularly compressed during installation into the frame 18 and snaps back to its original position or may be slightly compressed once the core portion is located in the inner channel 40. In accordance with yet another embodiment of the invention, both the frame 18 and core portion 22 can be constructed of one or more materials to facilitate installation in the manner as previously described.

Referring again to FIGS. 1-6, the core portion 22 preferably includes an inner support frame 44, with an annular floor 46 and front and rear walls 48 and 50, respectively, extending radially outwardly from opposite sides of the floor 46. A gap 52 (FIG. 3) is formed in the inner support frame 44, and preferably has the same angle "B" as the gap 34 of the frame 18 and the same angle "A" from the vertical centerline so that the gaps 34 and 52 are aligned. In this manner, the arrow shaft 35 can slip through both gaps during loading and unloading in the event the archery bow is not fired.

Figure 6:
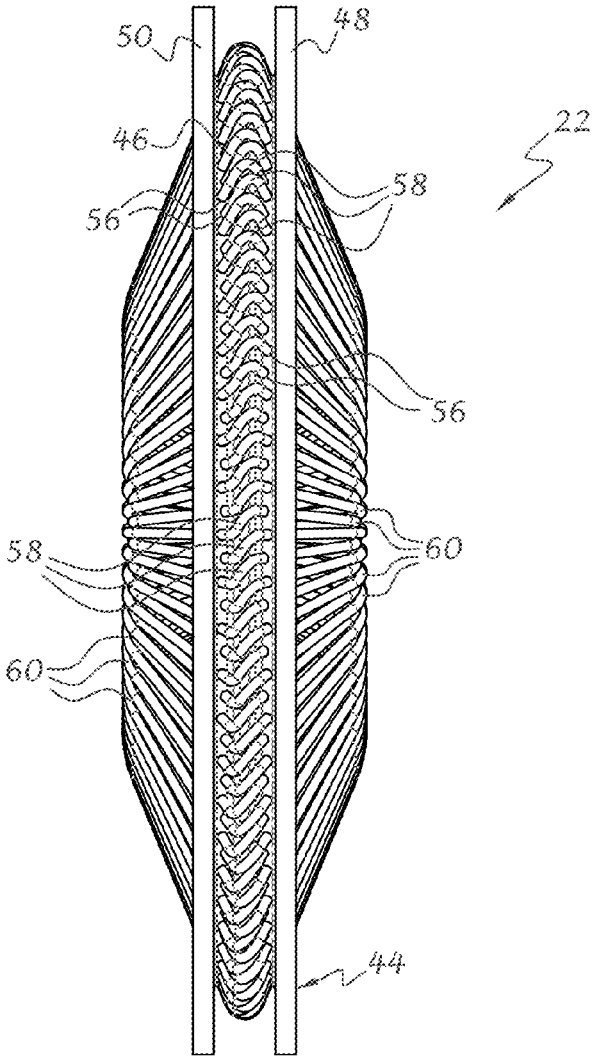
FIG. 6 is an enlarged side elevational view of a core portion of the arrow rest assembly.
Figure 5:
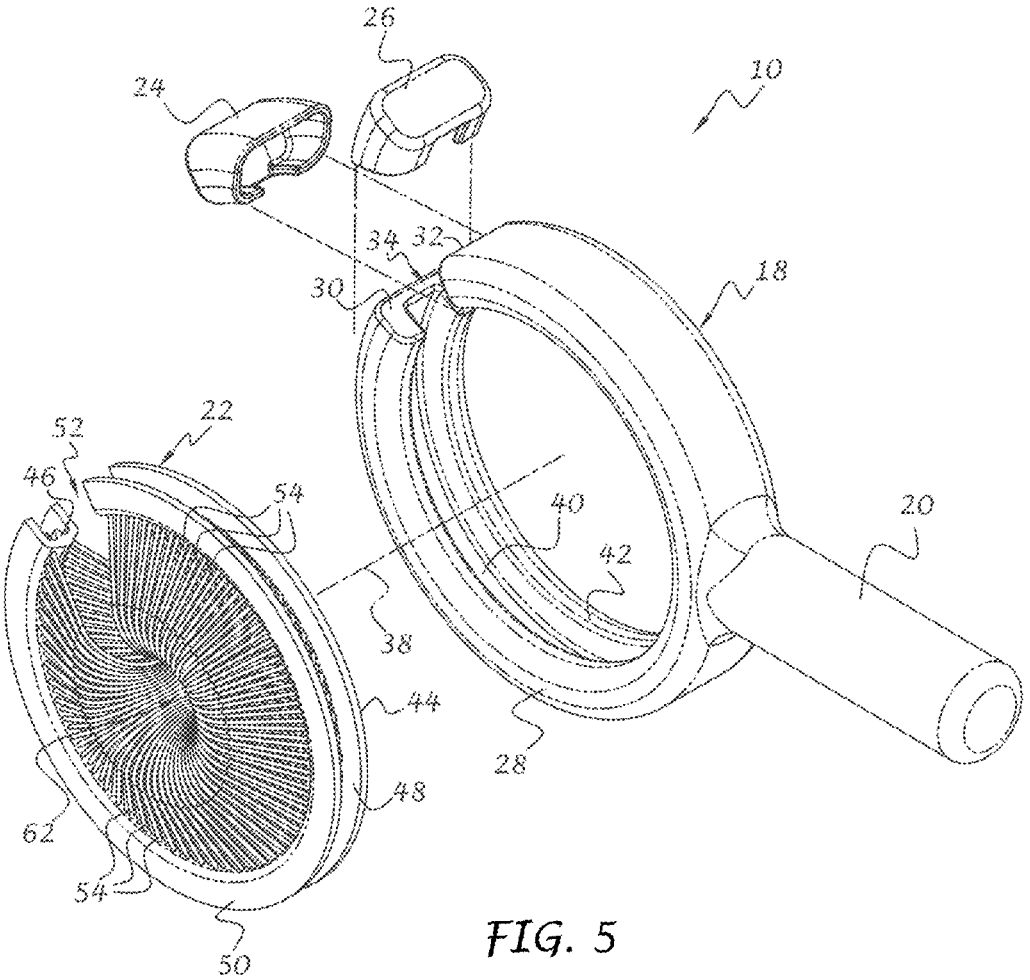
FIG. 5 is a rear isometric exploded view of the arrow rest assembly of the present invention.
Figure 7:
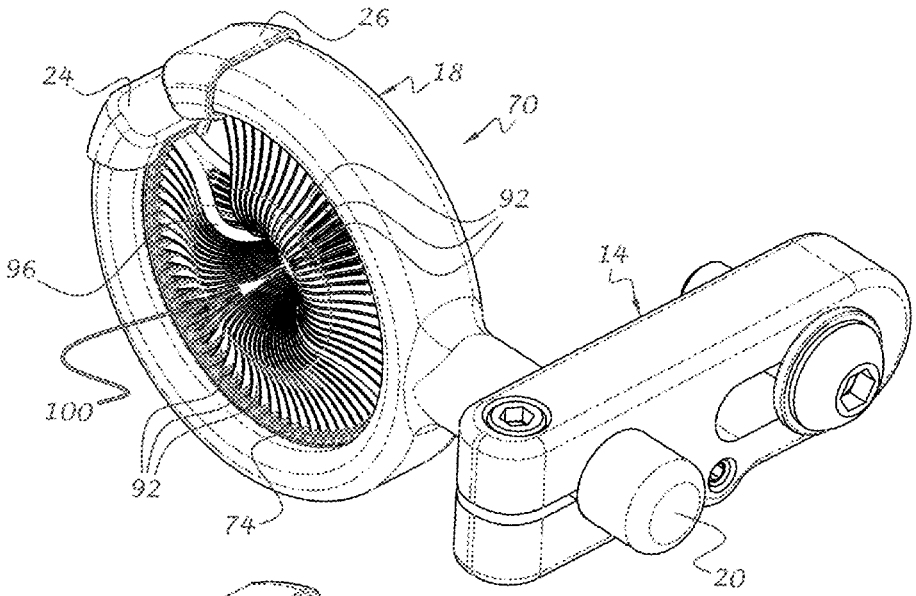
FIG. 7 is a rear isometric view of an arrow rest assembly in accordance with a further embodiment of the invention connected to a mounting bracket.
Figure 8:
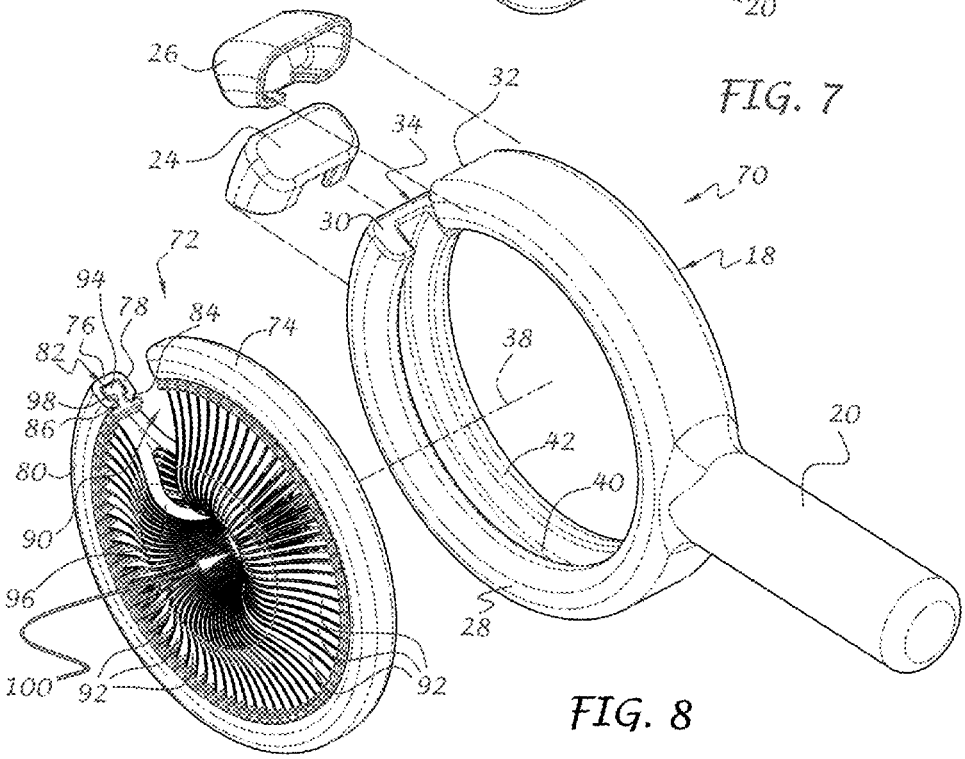
FIG. 8 is a rear isometric exploded view of the arrow rest assembly of FIG. 7.
Figure 9:
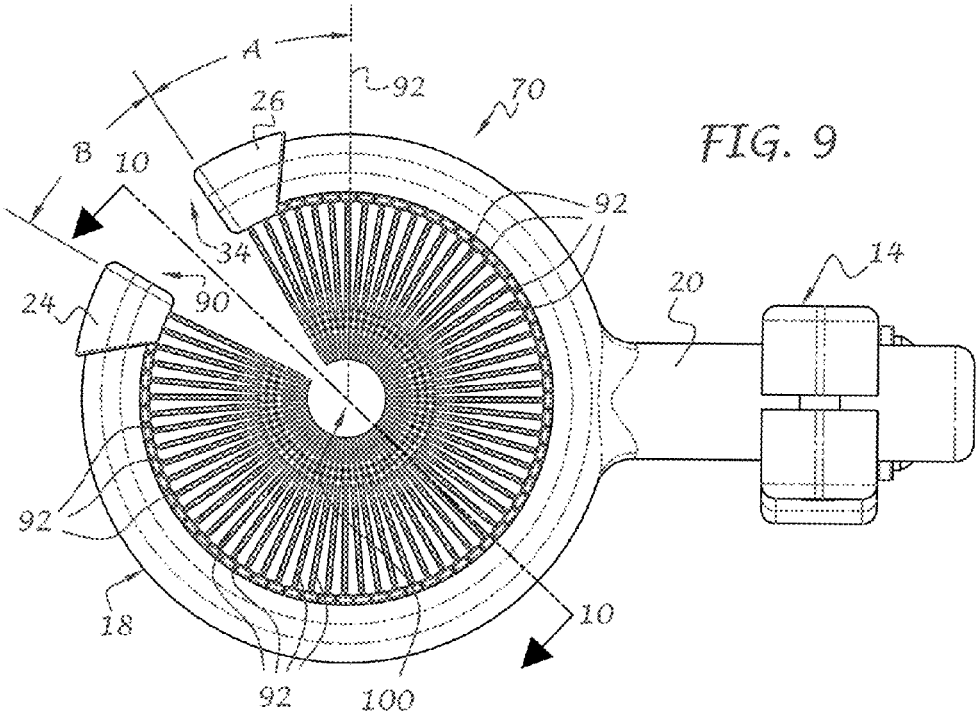
FIG. 9 is a rear elevational view of the arrow rest assembly of FIG. 7.

A plurality of support members 54, shown in this embodiment as generally teardrop-shaped loops (FIG. 4), are connected to the inner support frame 44. Each loop, as best shown in FIG. 6, in accordance with the present embodiment includes a small outer loop portion 58 and a large support portion 60. The loops are preferably constructed from a single length of metal or plastic wire or other strand(s) of material that have sufficient stiffness to hold their shape when supporting an arrow 16 (FIG. 1) and sufficient resilience to deflect to accommodate arrow deflection when the arrow is released from the archery bow during shooting.

In order to form the support members 54, the single length of material is spiraled around the annular floor 46 of the inner support frame 44. The annular floor 46 has a plurality of holes 56 formed therein to receive the length of wire to thereby form a small base portion 58, embodied as an outer loop portion, that spirals to a support portion 60, embodied as a large support portion, to thereby define the support members 54 during assembly of the core portion 22. It will be understood that the front wall and/or rear wall of the inner support frame 44 may have the holes 56 in addition to or in place of the holes 56 in the annular floor 46. The outer loops together form a central opening 62 for receiving and supporting the arrow 16. The support members also form a gap 64 with the same angle "B" as the gap 52 of the inner support frame 44 and the gap 34 of the outer support frame 18, and the same angle "A" from the vertical centerline 36 so that the gaps 34, 52, and 64 are aligned. In this manner, the arrow shaft 35 can slip through all three gaps and into the central opening 62 during loading and unloading. It will be understood that the support members 54 or teardrop-shaped loops can extend 360 degrees around the inner frame thereby eliminating the gaps and the end caps without departing from the spirit and scope of the invention. In this 360 degree embodiment, the user would simply load the arrow by inserting it axially through the central opening 62 rather than radially through the gaps.

The support members 54 are configured so that at least some of the large support portions 60 tangentially contact the arrow shaft 35, with each support member occupying a separate plane, and all planes being oriented in a direction that is at least generally parallel with a central axis 66 (FIG. 1) of the arrow shaft. In addition, the circumferentially spaced large support portions have a radial orientation such that the radially extending fletchings 68 of the arrow 16 pass through spaces between the loops no matter what position the fletchings may be in. If desired, the large support portions may include smaller support portions between larger support portions so that the support portions can collapse into each other, thereby allowing the support portions to compress where needed.

During assembly, the wire or strand is spiraled around the inner support frame 44 as previously described to form the base and support portions. The core portion 22 is then pressed into the outer support frame 18, whereupon depending on the material selected for the inner and outer support frames, one or both of the frames will flex until the inner support frame snap-fits into the annular raceway 40. The gaps in each support frame are then aligned and the end caps 24, 26 are subsequently installed for aesthetic appeal, to keep the gaps aligned, and to retain the core portion 22 within the outer support frame 18.

Referring now to FIGS. 7-10, an arrow rest assembly 70 in accordance with a further exemplary embodiment of the invention is illustrated. The arrow rest assembly 70 preferably includes an outer support frame 18 with an attached windage adjustment rod 20 that extends laterally therefrom and is received within the mounting bracket 14, as previously described, and an inner core portion 72 connected to the frame 18 for supporting an arrow 16 (FIG. 1). As in the previous embodiment, end caps 24, 26 are connected to opposing terminal ends 30, 32 of the frame for retaining the core portion 72 in the frame 18.

The inner core portion 72 preferably includes an inner support frame 74, with an annular floor 76 and front and rear walls 78 and 80, respectively, extending radially inwardly from opposite sides of the floor 76 to form an annular channel 82. The inner free ends 84, 86 are curved or bend slightly inwardly so that the channel 82 is partially closed, thereby forming an access slot 88 between the inner free ends 84, 86. A gap 90 (best shown in FIG. 9) is formed in the inner support frame 74, and preferably has the same angle "B" as the gap 34 of the frame 18 (FIG. 3) and the same angle "A" from the vertical centerline 91 so that the gaps 34 and 90 are aligned. In this manner, the arrow shaft 35 (FIG. 1) can slip through both gaps.

Figure 10:
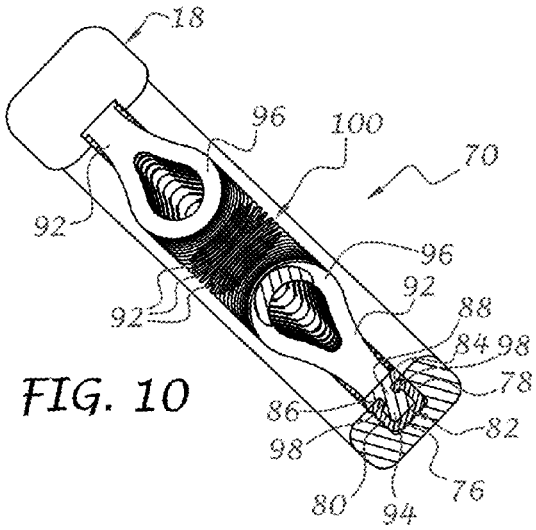
FIG. 10 is a sectional view thereof taken along line 10-10 of FIG. 9.

A plurality of support members 92, shown in this embodiment as generally teardrop-shaped loops (FIG. 10), are connected to the inner support frame 74. Each support member, as best shown in FIG. 10, in accordance with the present embodiment includes a base portion 94 that fits within the annular channel 82 of the inner support frame 74 and a support portion 96 that extends radially inwardly. The inner free ends 84, 86 of the walls 78, 80 engage opposing slots 98 formed in the base portion to ensure that the base portion 94 stays within the annular channel 82. The support members 92 are preferably plate-like with a relatively thin cross-sectional shape for the support portion 96 and a relatively thicker cross-sectional shape for the base portion 94 so that a large amount of support members can be installed in the annular channel 82 of the inner support frame 74.

The support members 92 are installed into the inner support frame 74 by aligning the base portion 94 with the annular channel 82 then sliding the base portion through the channel and held at a predetermined position. For the second and subsequent support members 92, the base portion 94 is slid along the channel until it contacts or is at least closely adjacent to a previously installed base portion 94. The entire channel 82 can be filled with the base portions 94 such that the support portions 96 together surround a substantial circumference of the arrow shaft. When the last support member 92 is installed, the inner core portion 72 can be installed in the outer support frame 18 in a manner as previously described with respect to the arrow rest assembly 10. The end caps 24 and 26 can then be slid over the outer support frame 18 and inner support frame 74 as previously described. It will be understood that the support members 92 can be installed before or after the support frames 18, 74 are connected together. In accordance with further embodiments of the invention, only a portion of the channel can contain the base portions arranged in such a manner to provide virtually full support of the arrow shaft, as will be described in greater detail below.

The support members 92 are configured so that at least some of the support portions 96 tangentially contact the arrow shaft 35 (FIG. 1) with each support member occupying a separate plane, and all planes being oriented in a direction that is at least generally parallel with the central axis 66 (FIG. 1) of the arrow shaft. In addition, the circumferentially spaced support portions have a radial orientation such that the radially extending fletchings 68 of the arrow 16 (FIG. 1) pass through spaces between the loops no matter what orientation the fletchings may be in. If desired, smaller support portions (not shown) may be inserted between the support portions 96 so that the loops can collapse into each other, thereby allowing the loops to compress where needed.

The radial orientation of the support members 92 with respect to the central axis 66 (FIG. 1) form a central opening 100 for receiving and supporting the arrow 16 in the axial direction. The support members 92 also form a gap 102 with the same angle "B" as the gap 90 of the inner support frame 74 and the gap 34 of the outer support frame 18, and the same angle "A" from the vertical centerline 36 (FIGS. 3 and 9) so that the gaps 34, 90, and 102 are aligned. In this manner, the arrow shaft 35 can slip through all three gaps and into the central opening 100 during loading and unloading. It will be understood that the support members 92 can extend 360 degrees around the inner frame thereby eliminating the gaps and the end caps without departing from the spirit and scope of the invention. In this 360 degree embodiment, the user would simply load the arrow by inserting it axially through the central opening 100 rather than radially through the gaps.

As shown, the support members are relatively thin in the radial direction but wide along the central axis 66. Each support member 92 is preferably constructed as a single unit through molding, die casting, machining, or other well known forming means. The support members 92 also have sufficient stiffness to hold their shape when supporting an arrow 16 (FIG. 1) and sufficient resilience to deflect in response to arrow deflection when the arrow is released from the archery bow during shooting.

Figure 10A:
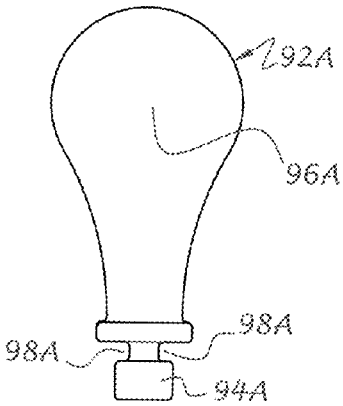
FIG. 10A is a side elevational view of a support member of an arrow rest assembly in accordance with another embodiment of the invention.

With particular reference to FIG. 10A, an enlarged side elevational view of a support member 92A in accordance with a further embodiment of the invention is illustrated. The support member 92A is similar in construction to the support member 92, with the exception that the support portion 96A is constructed of a solid piece of material. The base portion 94A is similar to the base portion 94 and includes slots or grooves 98A for retaining the support member 92A within the inner support frame 74 (FIG. 10). With this embodiment of the invention, the solid support portion 96A can be made of a more flexible material to compensate for the added stiffness of the solid material.

However, the support member 92A, including the solid support portion 96A as well as the support member 92 (FIG. 10) and other support members described herein, as well as other suitable support devices, can be constructed of any suitable material and/or hardness, including, but not limited to, elastomers, metal, composites, laminates, combinations thereof, and so on. It will be further understood that the support member 92A can take the place of the support member 92 or other support members as described herein, as well as other suitable support devices. In addition, both embodiments of the support members can be installed in the same inner support frame to give a customized or enhanced support for the arrow 16 (FIG. 1). From the foregoing, it will be further understood that the term "loop" as used herein can apply to both hollow and solid configurations of the support members for one or more of the embodiments disclosed in the present specification.

Figure 11:
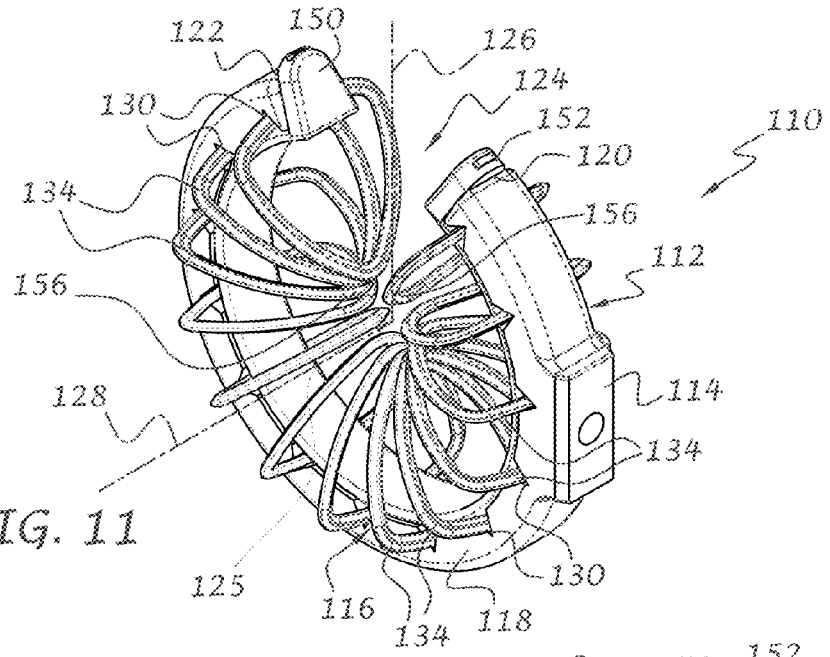
FIG. 11 is a rear isometric view of an arrow rest assembly in accordance with yet another embodiment of the invention.
Figure 12:
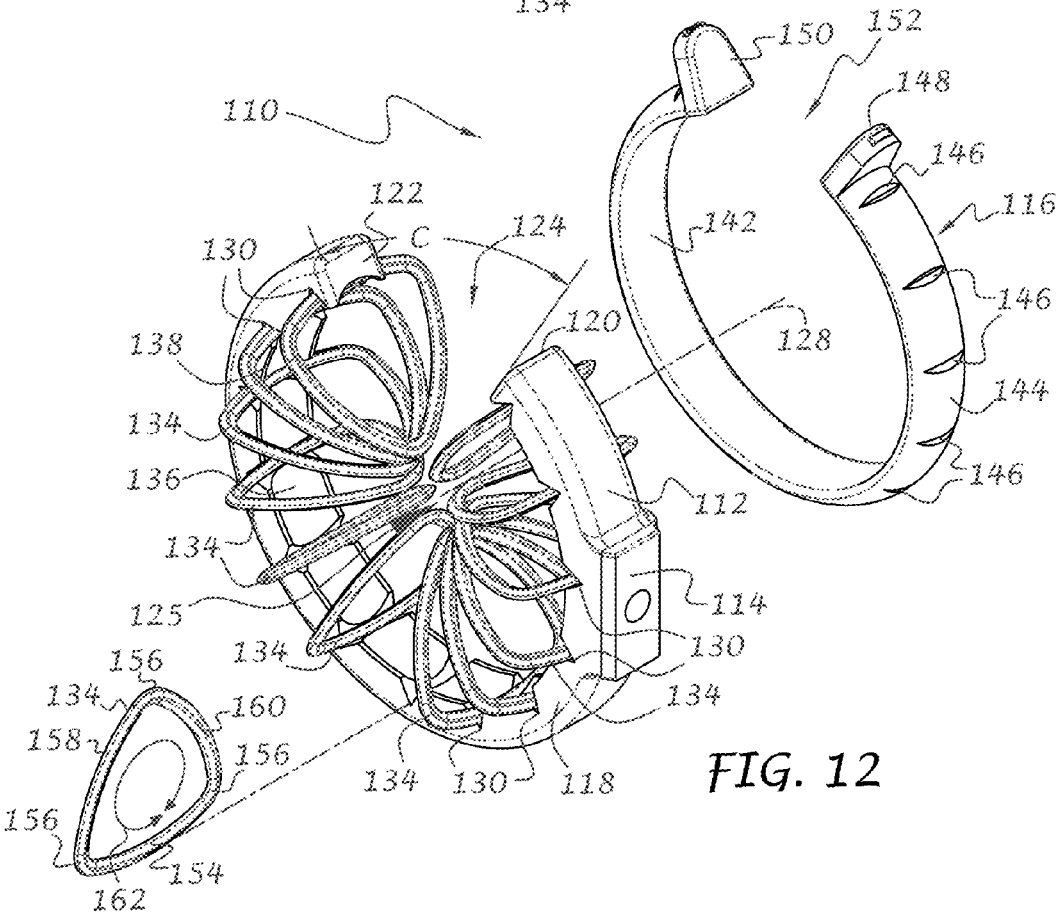
FIG. 12 is a rear isometric exploded view thereof.

Referring now to FIGS. 11 and 12, an arrow rest assembly 110 in accordance with another exemplary embodiment of the invention is illustrated. The arrow rest assembly 110 preferably includes an outer support frame 112 with a windage mount 114 for attachment to a windage adjustment rod (not shown) and an inner core portion 116 connected to the frame 112 for supporting an arrow 16 (FIG. 1).

The outer support frame 112 preferably comprises a generally annular-shaped body 118 with a first terminal end 120 circumferentially spaced from a second terminal end 122 to define a space or gap 124 therebetween. As shown, the gap 124 is in alignment with a vertical line 126 extending perpendicular to a central axis 128 of the outer support frame 112. The size and shape of the gap 124 is defined by an angle "C" between the first terminal end 120 and second terminal end 122 of the body 118 such that the gap 124 is generally wedge-shaped. The angle "C" is preferably large enough to accept an arrow shaft 35 (FIG. 1) of the largest available diameter such that the arrow shaft can easily slip through the gap 124 and be supported on and/or captured by the core portion 116. Circumferentially spaced inner notches 130 are formed in the inner surface 132 of the outer support frame 112 for receiving support members 134.

Although the gap 124 is shown centered on the vertical line 126, it will be understood that the gap can be circumferentially spaced from the vertical line or can be located at any other position without departing from the spirit and scope of the invention. It will be further understood that the gap 124 can be removed such that the frame 112 forms a fully enclosed aperture or central opening 125. With this arrangement, as previously described with respect to the preceding embodiments, the arrow 16 (FIG. 1) can be inserted axially into the central opening the central axis 128 of the frame. Moreover, it will be understood that the present invention is not limited to an annular frame but may be of any shape and/or configuration for supporting and retaining the core portion 116. It is also anticipated that the frame may be eliminated and that the core portion 116 be directly connected to a windage rod or other structure for mounting the core portion 116 to the riser 12 (FIG. 1) of a bow.

An inner annular channel 136 is formed in the inner surface 138 of the annular-shaped body 118 for receiving the inner core portion 116. In accordance with one preferred embodiment of the invention, the outer support frame 112 is formed of a material that is sufficiently resilient to expand over the core portion 116 and snap back to its original position when the core portion 116 is received within the inner annular channel 136 during assembly of the arrow rest assembly 110. In accordance with another preferred embodiment of the invention, the core portion 116 is constructed of one or more materials that are sufficiently resilient such that the core portion is annularly compressed during installation into the outer support frame 112 and snaps back to its original position or may be slightly compressed once the core portion is located in the inner channel 136. In accordance with yet another embodiment of the invention, both the outer frame 112 and core portion 116 can be constructed of one or more materials to facilitate installation in the manner as previously described.

The inner core portion 116 preferably includes an inner support frame 140, with an annular-shaped body 142 and an outer surface 144 that is semi-circular in cross section or of a suitable complementary shape to the inner annular channel 136 so that the inner core portion 116 fits snugly in the outer support frame 112. Circumferentially spaced outer notches 146 are formed in the outer surface 144 of the inner support frame 140 for receiving the support members 134. Flanges 148 and 150 are formed on the inner free ends of the inner support frame 140 and are biased against the terminal ends 120, 122, respectively, of the outer support frame 112. In this manner, the inner and outer support frames are held together under biasing force from the inner support frame. It will be understood that other means for connecting the frames together can be used without departing from the spirit and scope of the invention including, but not limited to, adhesive bonding, welding, mechanical fastening, and so on. Moreover, as in the previous embodiments, it will be understood that the inner core portion can be used without the outer support frame 112. A space or gap 152 (best shown in FIG. 12) is formed in the inner support frame 140, and preferably has the same angle "C" as the gap 124 of the frame 112 so that the gaps are aligned. In this manner, the arrow shaft 35 (FIG. 1) can slip through both gaps.

The plurality of support members 134, shown in this embodiment as generally triangular-shaped loops with a first leg or base portion 154 that is captured in opposing inner and outer notches 130, 146, respectively, in the outer and inner support frames. Each support member also has an arcuate apex support portion 156 formed by second and third converging legs 158, 160, respectively, that extend from the first leg 154. The support members 134 are configured so that at least some of the arcuate apex support portions 156 tangentially contact the arrow shaft 35 (FIG. 1), with each support member occupying a separate plane, and all planes being oriented in a direction that is at least generally parallel with the central axis 66 (FIG. 1) of the arrow shaft opening. In addition, the circumferentially spaced support portions have a radial orientation such that the radially extending fletchings 68 of the arrow 16 (FIG. 1) pass through spaces between the support portions no matter what orientation the fletchings may be in. When one of the apex support portions 156 becomes worn, the associated support member can be removed and rotated either clockwise or counterclockwise, as shown by arrow 162 (FIG. 12) to expose a new apex support portion for use. Each of the support members 134 can be adjusted for wear in the same manner. It will be understood that the support members 134 need not be in the form of triangular-shaped loops but may include other shapes such as circular, teardrop, oval, and so on. The support members 134 are preferably made of a material and dimensions so that the support members are sufficiently stiff to support the weight of an arrow yet sufficiently resilient to accommodate arrow deformation when the arrow is released from the bow during shooting.

Figure 13:
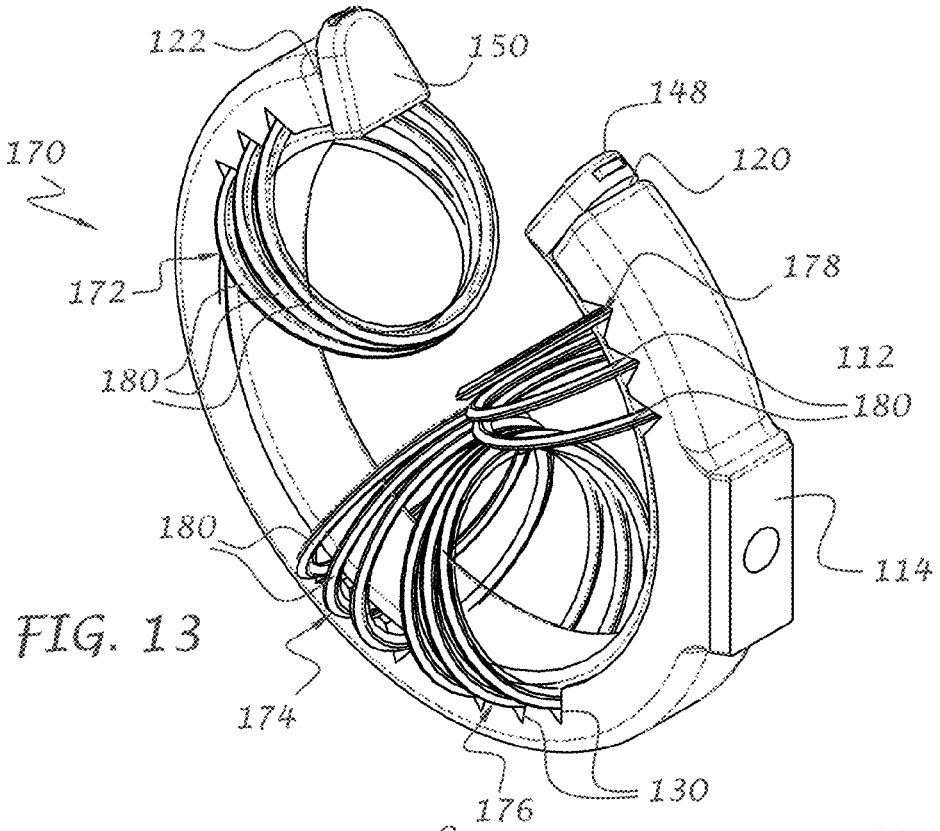
FIG. 13 is a rear isometric view of an arrow rest assembly in accordance with yet a further embodiment of the invention.
Figure 14:
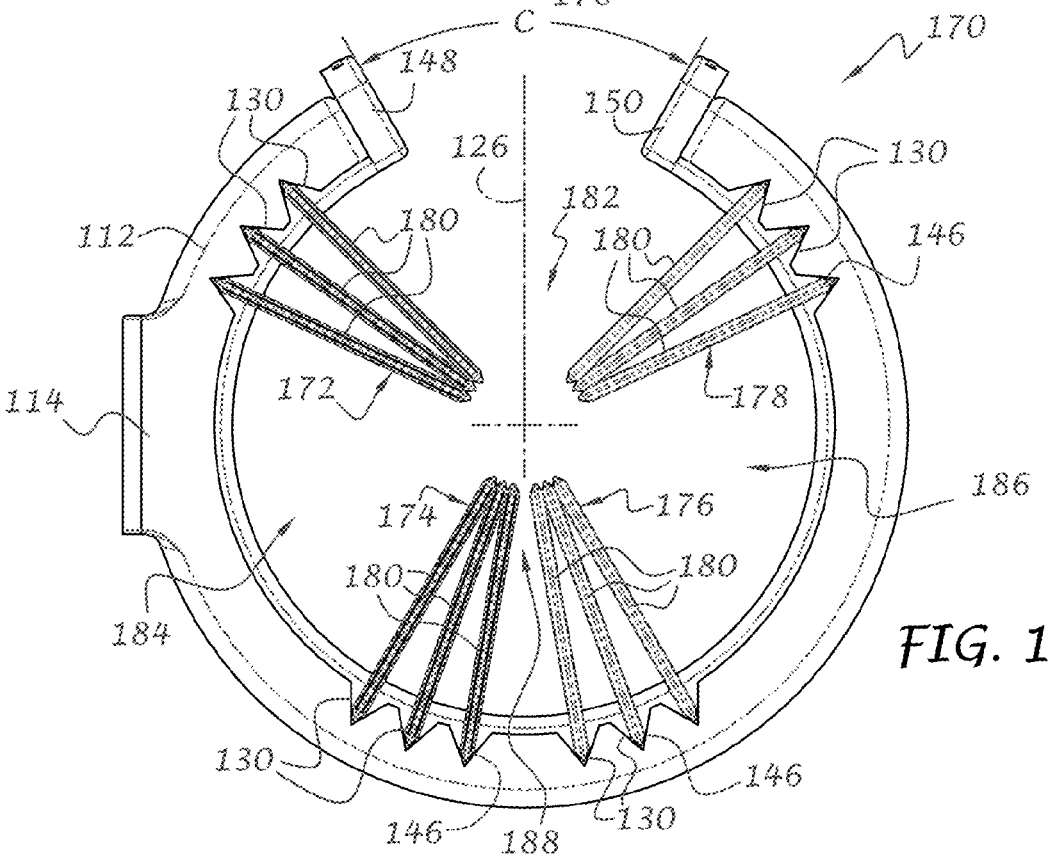
FIG. 14 is a rear elevational view thereof.

Referring now to FIGS. 13 and 14, an arrow rest assembly 170 in accordance with another embodiment of the invention is illustrated. The arrow rest assembly 170 is similar in construction to the arrow rest assembly 110 previously described, with the exception that four sets or groups 172, 174, 176, and 178 of three support members 180 are captured in the opposing inner notches 130 and outer notches 146 (shown in hidden line in FIG. 14), respectively, of the outer and inner support frames 112 and 140. As shown, the support members 180 are circular in shape with a circular cross section. As in the previous embodiments, the support members 180 are configured so that there is tangential contact between at least some of the support members 180 and the arrow shaft 35 (FIG. 1), with each support member occupying a separate plane, and all planes being oriented in a direction that is at least generally parallel with the central axis 66 (FIG. 1) of the arrow shaft. In addition, the circumferentially spaced groups of support members 180 have a radial orientation such that the radially extending fletchings 68 of the arrow 16 (FIG. 1) can pass through spaces between the loops no matter what orientation the fletchings may be in. However, in this particular embodiment, spaces 182, 184, and 186 between the groups 178 and 172, 176 and 174, and 176 and 178, respectively, accommodate the fletchings 68 of the arrow 16 (FIG. 1) with the cock feather oriented upwards. Moreover, a smaller space 188 between the groups 174 and 176 can also accommodate a cock feather down orientation. Although four sets of three support members are shown, it will be understood that more or less sets and/or more or less support members per set can be provided without departing from the spirit and scope of the invention. It will be further understood that the support members 180 need not be in the form of circular-shaped loops but may include other shapes such as triangular, teardrop, oval, and so on. The support members 180 can also be constructed of any suitable cross section such as round, triangular, square, octagonal, and so on. As in the previous embodiments, the support members 180 are preferably made of a material and dimensions so that the support members are sufficiently stiff to support the weight of an arrow yet sufficiently resilient to accommodate arrow deformation when the arrow is released from the bow during shooting.

Figure 15:
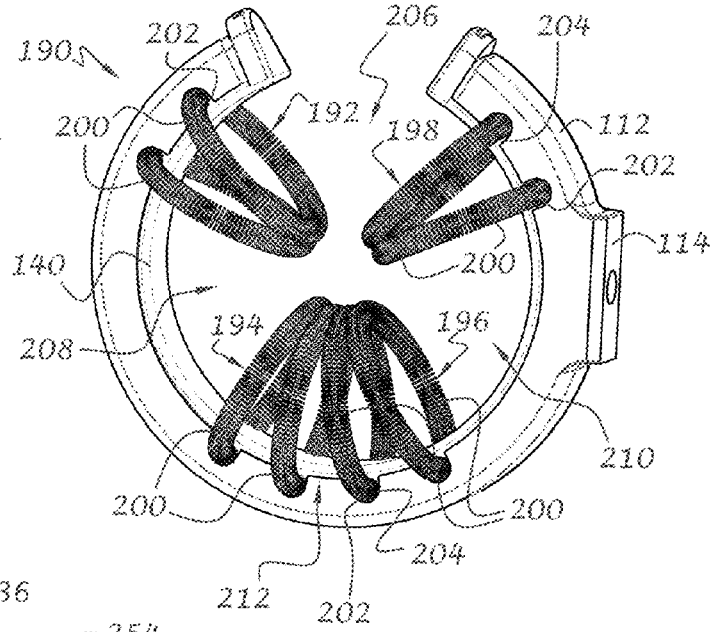
FIG. 15 is a front isometric view of an arrow rest assembly in accordance with yet another embodiment of the invention.

Referring now to FIG. 15, an arrow rest assembly 190 in accordance with yet another embodiment of the invention is illustrated. The arrow rest assembly 190 is similar in construction to the arrow rest assembly 170 previously described (FIGS. 13 and 14), with the exception that four sets or groups 192, 194, 196, and 198 of two support members 200 are captured in opposing inner and outer circular notches 202 and 204 respectively, of the outer and inner support frames 140, 112. As shown, the support members 200 are circular in shape and are preferably constructed from what is generically known as a pipe cleaner or chenille stem. The pipe cleaner support members 200 can be made from two lengths of core wires that are twisted together to capture short lengths of fiber or tufts between them, in a well-known manner. Any suitable wire material, shape and size can be used, as long as the wire(s) are stiff enough to support the weight of an arrow yet resilient enough to flex during shooting to accommodate arrow deflection. Likewise, any suitable fiber can be used, such as polyester, cotton, chenille, nylon, polypropylene, and so on, to eliminate or substantially reduce noise of the arrow shaft as it moves along the support members 200. As in the previous embodiments, the support members 200 are configured to tangentially contact the arrow shaft 35 (FIG. 1), with each support member occupying a separate plane, and all planes being oriented in a direction that is at least generally parallel with the central axis 66 (FIG. 1) of the arrow shaft.

The circumferentially spaced groups of support members 200 have a first space 206 between groups 190 and 192, a second space 208 between groups 192 and 194, and a third space 210 between groups 196 and 198. The spaces 206, 208, and 210 accommodate the fletchings 68 of the arrow 16 (FIG. 1) with the cock feather oriented upwards. Although four sets of two support members are shown, it will be understood that more or less sets and/or more or less support members per set can be provided without departing from the spirit and scope of the invention. Moreover, a smaller fourth space 212 between the groups 194 and 196 can also accommodate a cock feather down orientation. It will be understood that the support members 200 can be of any suitable shape and cross dimension.

Figure 16:
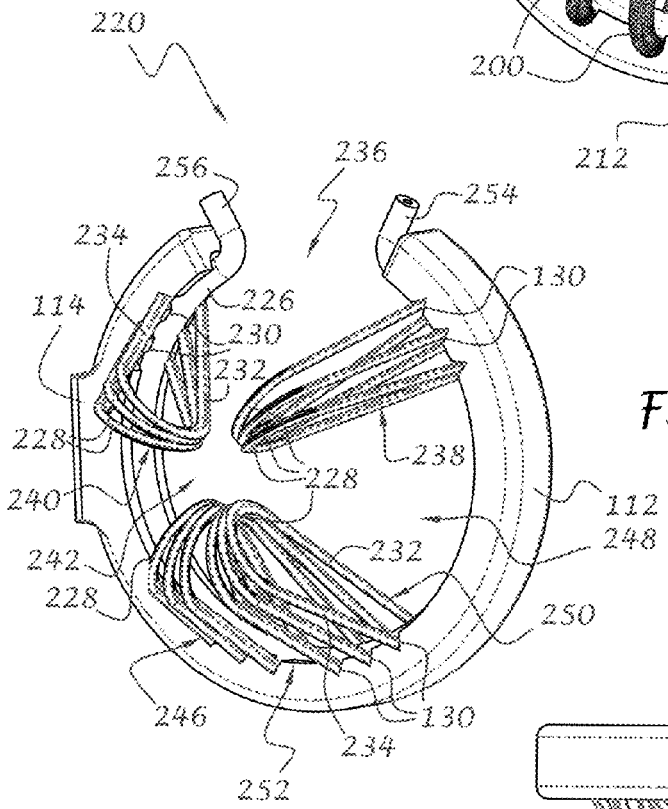
FIG. 16 is a front isometric view of isometric view of an arrow rest assembly in accordance with an additional embodiment of the invention.
Figure 17:
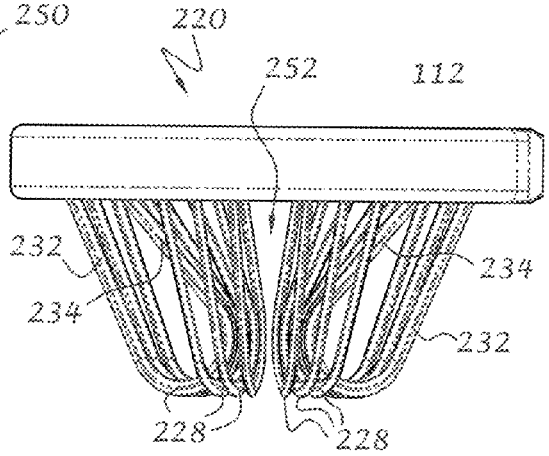
FIG. 17 is a bottom plan view thereof.

Referring now to FIGS. 16 and 17, an arrow rest assembly 220 in accordance with yet another embodiment of the invention is illustrated. The arrow rest assembly 220 is similar in construction to the arrow rest assembly 170 (FIGS. 13 and 14) previously described, with the exception that the support members 222 are generally teardrop-shaped with relatively small inner curved base portions 224 captured between the inner notches 130 of the outer support frame 112 and the outer notches 230 (FIG. 16) of the inner support frame 226, and relatively large outer curved support portions 228 that extend forwardly of the of the support frames 112, 226 and connected to the small curved support portions via legs 232 and 234. As in the previous embodiments, the support members 222 are configured so that there is tangential contact between a portion of the outer curved section 228 of at least some of the support members 222 and the arrow shaft 35 (FIG. 1), with each support member occupying a separate plane, and all planes being oriented in a direction that is at least generally parallel with the central axis 66 (FIG. 1) of the arrow shaft. In addition, the circumferentially spaced groups of support members 222 have a radial orientation such that the radially extending fletchings 68 of the arrow 16 (FIG. 1) can pass through spaces between the loops no matter what orientation the fletchings may be in. However, as in the FIG. 13 embodiment, the space 236 between the groups 238 and 240 of support members 222, the space 242 between the groups 240 and 246 of support members 222, and the space 248 between the groups 250 and 238 of the support members 222 accommodate the fletchings 68 of the arrow 16 (FIG. 1) with the cock feather oriented upwards. Moreover, a smaller space 252 between the groups 246 and 250 can also accommodate a cock feather down orientation. Although four groups of three support members are shown, it will be understood that more or less groups and/or more or less support members 222 per set can be provided without departing from the spirit and scope of the invention. It will be further understood that the support members 222 need not be in the form of teardrop-shaped loops but may include other shapes such as triangular, oval, circular, and so on. The support members 222 can also be constructed of any suitable cross section such as round, triangular, square, octagonal, and so on. As in the previous embodiments, the support members 222 are preferably made of a material and dimensions so that the support members are sufficiently stiff to support the weight of an arrow yet sufficiently resilient to accommodate arrow deformation when the arrow is released from the bow during shooting. The forward extension of the support members 222 from the support frames 112 and 226 support the arrow at a position forward of the support frames to provide greater forgiveness for the novice archer since the point of contact is at or close to the location of the berger hole on the riser of the archery bow. The inner support frame 226 is preferably constructed of an insulated wire clip or the like with turned-up ends 254, 256 that can be grasped and pinched towards each other to engage and disengage the outer support frame 112 during assembly or disassembly of the arrow rest assembly 190.

Figure 18:
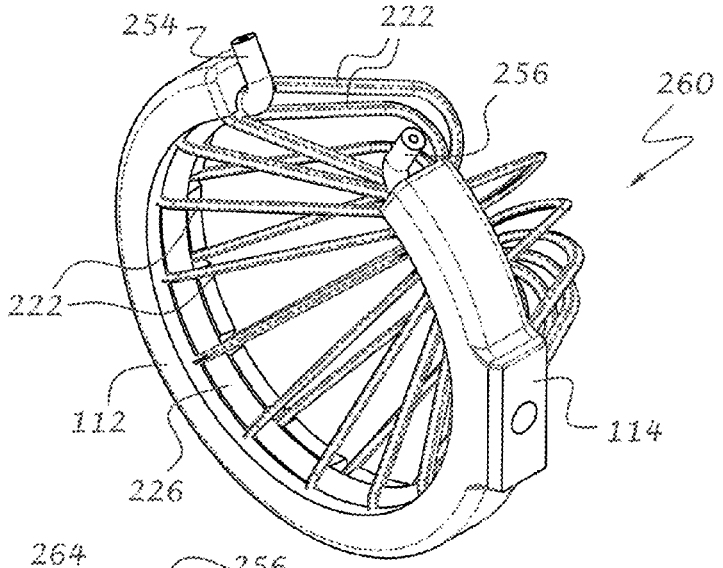
FIG. 18 is a rear isometric view of a further embodiment of the invention.
Figure 19:
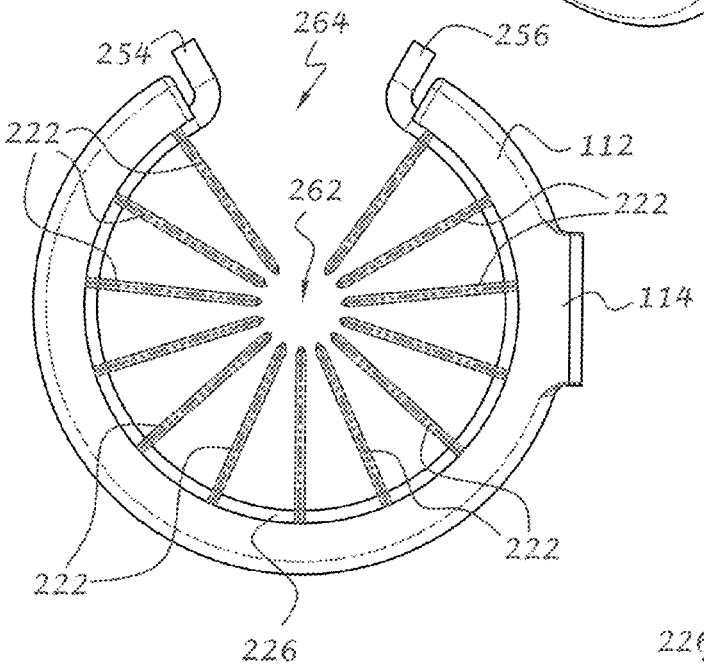
FIG. 19 is a rear elevational view thereof.
Figure 20:
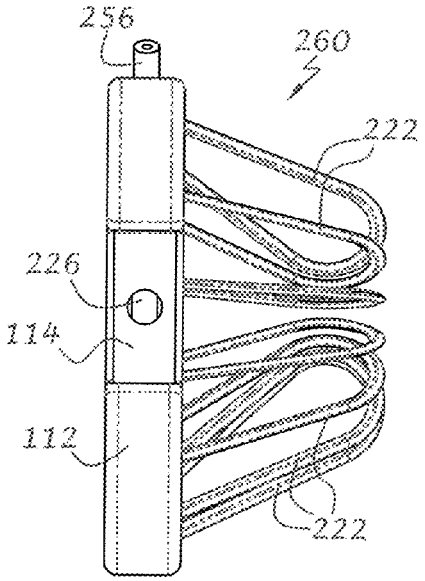
FIG. 20 is a left side elevational view thereof.

Referring now to FIGS. 18-20, an arrow rest assembly 260 in accordance with a further embodiment of the invention is illustrated. The arrow rest assembly 260 is similar in construction to the arrow rest assembly 220 (FIGS. 16-17) previously described, with the exception that the support members 222 are evenly circumferentially spaced around the outer support frame 112 and inner support frame 226. The support members 226, as in the previous embodiment, have the inner curved sections captured between notches in the inner and/or outer frame(s), with the outer curved sections 228 extending forwardly from the support frames (FIGS. 18 and 20). As in the previous embodiments, the support members 222 extend radially towards the center of a central opening or aperture for receiving and holding an arrow shaft 32 (FIG. 1). A gap 264 defined by the terminals ends of the frames 112, 226, is provided for radially loading the arrow shaft into the central opening 262. However, it will be understood that the gap 264 can be eliminated such that the support members 222 extend 360 degrees around the central opening 262 so that the arrow can be loaded in an axial direction, as previously described with prior embodiments. With the support members 222 being fewer in number around the frames 112, 226, spaces 266 are formed between adjacent support members. The spaces 266 are sufficiently wide to accommodate the fletchings 68 of an arrow 16 (FIG. 1) no matter what orientation the cock feather is in.

It will be understood that the term "preferably" as used throughout the specification refers to one or more exemplary embodiments of the invention and therefore is not to be interpreted in any limiting sense. In addition, terms of orientation and/or position as may be used throughout the specification denote relative, rather than absolute orientations and/or positions.

It will be appreciated by those skilled in the art that changes could be made to the embodiments described above without departing from the broad inventive concept thereof. For example, the core portion can be configured to be used without the outer frame and thus may have added thickness, structure, and/or different configurations or geometries to strengthen the core portion such that the outer frame is not needed. In this instance, a windage plug can be directly connected thereto or integrally molded, machined, or otherwise formed therewith. In addition, the outer frame can be configured to directly receive and retain the arrow support members without the inner frame. Moreover, although the support members have been shown as surrounding the arrow shaft, the support members can be used to guide the arrow shaft onto another type of support, or the support members can be used to support the arrow shaft and other structure can be used to guide the arrow shaft towards the support members. In addition, one or more combinations of the different support members in each of the disclosed embodiments herein can be combined into a single arrow rest assembly. Furthermore, although it is preferred that the support members have curved outer support portions that form the central opening at a plurality of single tangential points (one tangential point per support member), the support members can extend along a length of the arrow shaft in an axial direction thereof when installed in the arrow rest assembly rather than having a curved loop portion that extends only tangentially to the arrow shaft or arrow rest opening for receiving the arrow shaft. It will be understood, therefore, that the present invention is not limited to the particular embodiments disclosed, but also covers modifications within the spirit and scope of the invention as defined by the appended claims.

What is claimed is:

1. An arrow rest assembly for supporting the shaft of an arrow, comprising:

a first support frame; and a plurality of support members connected to the support frame for defining at least a portion of an opening with a central axis for receiving the shaft of an arrow, each support member having:

a base portion connected to the first support frame; and a support portion extending inwardly into the opening from the base portion, the support portion forming a tangential point of the opening for tangentially engaging the shaft of an arrow;

wherein the support portion is larger than the base portion.

2. An arrow rest assembly according to claim 1, wherein the support portion is teardrop-shaped.

3. An arrow rest according to claim 1, wherein at least some of the support members are solid.

4. An arrow rest assembly for supporting the shaft of an arrow, comprising:

a first support frame; and a plurality of support members connected to the support frame for defining at least a portion of an opening with a central axis for receiving the shaft of an arrow, each support member having:

a base portion connected to the first support frame; and a support portion extending from the base portion, the support portion forming a tangential point of the opening for tangentially engaging the shaft of an arrow;

wherein the plurality of support members comprises a single length of material continuously looped about the first support frame to thereby define the opening for receiving the arrow shaft.

5. An arrow rest assembly according to claim 4, wherein the first support frame includes a wedge-shaped gap that communicates with the opening for receiving the arrow shaft.

6. An arrow rest assembly according to claim 4, wherein the support members extend radially inwardly toward the central axis, each support member being oriented along a separate plane from the other support member, with all planes being at least generally parallel with the central axis.

7. An arrow rest assembly for supporting the shaft of an arrow, comprising:

a first support frame; and a plurality of support members connected to the support frame for defining at least a portion of an opening with a central axis for receiving the shaft of an arrow, each support member having:

a base portion connected to the first support frame; and a support portion extending from the base portion, the support portion forming a tangential point of the opening for tangentially engaging the shaft of an arrow;

wherein at least some of the support members are hollow.

8. An arrow rest assembly for supporting the shaft of an arrow, comprising:

a first support frame; and a plurality of support members connected to the support frame for defining at least a portion of an opening with a central axis for receiving the shaft of an arrow, each support member having:

a base portion connected to the first support frame; and a support portion extending from the base portion, the support portion forming a tangential point of the opening for tangentially engaging the shaft of an arrow; and a second support frame adapted for receiving the first support frame therein.

9. An arrow rest assembly according to claim 8, wherein the first and second support frames are annular in shape.

10. An arrow rest assembly for supporting the shaft of an arrow, comprising:

a first support frame; and a plurality of support members connected to the support frame for defining at least a portion of an opening with a central axis for receiving the shaft of an arrow, each support member having:

a base portion connected to the first support frame; and a support portion extending from the base portion, the support portion forming a tangential point of the opening for tangentially engaging the shaft of an arrow;

wherein the first support frame comprises a channel and the base portion of each of the support members is shaped to fit within the channel.

11. An arrow rest assembly according to claim 10, wherein the base portion is solid and the support portion is hollow.

12. An arrow rest assembly according to claim 10, wherein the base and support portions are solid.

13. An arrow rest assembly according to claim 10, wherein a thickness of each support member is much smaller than a width of the support portion so that a large number of support members can be installed in the first support frame.

14. An arrow rest assembly according to claim 13, wherein the support portion is circular in shape and the support members are oriented to extend circumferentially around the first support frame radially toward the central axis so that the fletchings of an arrow can slip between adjacent support members when being shot in any orientation.

15. An arrow rest assembly according to claim 10, wherein the first support frame is circular and the support members are arranged circumferentially around the first support frame to form the opening.

16. An arrow rest assembly according to claim 15, and further comprises a wedge-shaped gap in the first support frame and between a first and last of the support members so that the arrow shaft can slip through the gap and into the opening.

17. An arrow rest assembly for supporting the shaft of an arrow, comprising:

a first support frame; and a plurality of support members connected to the support frame for defining at least a portion of an opening with a central axis for receiving the shaft of an arrow, each support member having:

a base portion connected to the first support frame; and a support portion extending from the base portion, the support portion forming a tangential point of the opening for tangentially engaging the shaft of an arrow;

wherein the support members are circular in shape and connected to the first support frame in a rotatable manner to adjust a contact position of the support members with the arrow shaft to expose a surface that has not been subjected to wear thereby prolonging the life of the support members.

18. An arrow rest assembly for supporting the shaft of an arrow, comprising:

a first support frame; and a plurality of support members connected to the support frame for defining at least a portion of an opening with a central axis for receiving the shaft of an arrow, each support member having:

a base portion connected to the first support frame; and a support portion extending from the base portion, the support portion forming a tangential point of the opening for tangentially engaging the shaft of an arrow;

wherein the support members are triangular in shape with three corner segments for tangentially contacting the arrow shaft, each support member extending along a separate plane that is parallel with the central axis, the support members being connected to the first support frame in a rotatable manner to expose one of the corner segments that has not been subjected to wear, thereby prolonging the life of the support members.

19. An arrow rest assembly for supporting the shaft of an arrow, comprising:

a first support frame; and a plurality of support members connected to the support frame for defining at least a portion of an opening with a central axis for receiving the shaft of an arrow, each support member having:

a base portion connected to the first support frame; and a support portion extending from the base portion, the support portion forming a tangential point of the opening for tangentially engaging the shaft of an arrow;

wherein the support portion of each support member extends forwardly of the first support frame such that the tangential contact between the support portion and the arrow shaft is forward of the first support frame.

20. An arrow rest assembly for supporting the shaft of an arrow, comprising:

a first support frame; and a plurality of support members connected to the support frame for defining at least a portion of an opening with a central axis for receiving the shaft of an arrow, each support member having:

a base portion connected to the first support frame; and a support portion extending from the base portion, the support portion forming a tangential point of the opening for tangentially engaging the shaft of an arrow; and a second support frame for receiving the first support frame therein, the first and second support frames having aligned notches for entrapping the base portion of each support member therein.

* * * * *